US010311761B2

(12) United States Patent
Balser

(10) Patent No.: US 10,311,761 B2
(45) Date of Patent: Jun. 4, 2019

(54) STORAGE LABEL DEVICE

(71) Applicant: Lynnette Balser, Tellico Plains, TN (US)

(72) Inventor: Lynnette Balser, Tellico Plains, TN (US)

( * ) Notice: Subject to any disclaimer, the term of this patent is extended or adjusted under 35 U.S.C. 154(b) by 0 days.

(21) Appl. No.: 15/782,191

(22) Filed: Oct. 12, 2017

(65) Prior Publication Data

US 2018/0108279 A1 Apr. 19, 2018

Related U.S. Application Data

(60) Provisional application No. 62/407,640, filed on Oct. 13, 2016.

(51) Int. Cl.
*G09F 3/20* (2006.01)

(52) U.S. Cl.
CPC ..... *G09F 3/204* (2013.01); *G09F 3/201* (2013.01)

(58) Field of Classification Search
CPC ... G09F 1/103; G09F 1/10; G09F 3/20; G09F 3/16; G09F 3/204; G09F 3/201; B42F 15/066
See application file for complete search history.

(56) References Cited

U.S. PATENT DOCUMENTS 3,608,156 A * 9/1971 Ward ..... G09F 3/08 206/389
4,011,636 A * 3/1977 Malacheski ..... D06F 55/00 24/532
D351,960 S * 11/1994 Golub ..... D6/513
5,384,937 A * 1/1995 Simon ..... H02G 3/0443 211/181.1
5,645,175 A * 7/1997 Wood ..... A47F 5/0869 211/57.1
D461,507 S * 8/2002 Nagel ..... D20/43
7,387,212 B2 * 6/2008 Costa ..... A47B 47/022 211/90.01
8,097,808 B2 * 1/2012 Quertelet ..... H02G 3/0443 174/95
2004/0035038 A1 * 2/2004 Pomerantz ..... G09F 3/204 40/661
2006/0059756 A1 * 3/2006 Wells ..... G09F 3/20 40/654.01

* cited by examiner

*Primary Examiner* — Cassandra Davis

(74) *Attorney, Agent, or Firm* — Matthew M. Googe; Robinson IP Law, PLLC

(57) ABSTRACT

A storage label device for mounting a label on a storage device is provided. The storage label device includes: a label holder body having a smooth front face and an opposing back face, the holder body extending between a top edge, a bottom edge, a first side, and a second side; a label pouch attached to the smooth front face of the label holder for receiving a label within the label pouch; and a clip portion formed along the top edge of the label holder body, extending from the back face at the top edge of the label holder and curving downward at a distal end of the clip portion to form a downward-facing hook. The label holder body is curved between the top edge and the bottom edge such that the bottom edge is aligned between the back face at the top edge and the distal end of the clip portion.

8 Claims, 8 Drawing Sheets

Prior Art

STORAGE LABEL DEVICE

CROSS-REFERENCE TO RELATED APPLICATION

This application claims priority to U.S. Provisional Patent Application Ser. No. 62/407,640 for a "Universal storage identification system for wire or other shelving and containers such as storage cubes" filed on Oct. 13, 2016, the contents of which are incorporated herein by reference in its entirety.

FIELD

This disclosure relates to a device for storage identification. More particularly, this disclosure relates to a label holder for mounting a label to a shelf or other storage location.

BACKGROUND

Identifying objects stored on shelves is often difficult, and it may be impossible to identify what is stored on wire shelving, other types of shelving, or in containers such as storage cubes, cubbies, or bins. Adhesive labels typically do not adhere to wire shelving and will either fall off or leave sticky residue on other types of shelving and containers such as storage cubes, cubbies, and bins. Existing labeling systems or devices are also not typically repositionable and reusable. An additional difficulty is that storage shelving products such as wire shelves may be available in varying sizes such that wires of the shelf from one manufacturer may have a spacing that is different from wire shelving from another manufacturer, thereby making it impossible to use a label holder designed for one shelf for use with a shelf from a different manufacturer.

What is needed, therefore, is a storage label device that mounts onto wire shelving and containers such as storage cubes, cubbies, and bins, and is repositionable and reusable with no sticky residue, thereby providing easy long-term storage identification.

SUMMARY

The above and other needs are met by a storage label device. In a first aspect, a storage label device for mounting a label on a storage device includes: a label holder body having a smooth front face and an opposing back face, the holder body extending between a top edge, a bottom edge, a first side, and a second side; a label pouch attached to the smooth front face of the label holder for receiving a label within the label pouch; and a clip portion formed along the top edge of the label holder body, extending from the back face at the top edge of the label holder and curving downward at a distal end of the clip portion to form a downward-facing hook. The label holder body is curved between the top edge and the bottom edge such that the bottom edge is aligned between the back face at the top edge and the distal end of the clip portion.

In one embodiment, the label holder body is resiliently flexible relative to the clip portion. In another embodiment, the storage label device further includes a lip formed in the clip portion. In yet another embodiment, the label holder body and clip portion are integrally formed as a single piece. In one embodiment, the label holder body and clip portion are molded from a resilient plastic.

In a second aspect, a storage label device for mounting a label on a wire shelf is provided, the wire shelf having a first horizontal wire, a second horizontal wire parallel to and below the first horizontal wire, and a plurality of longitudinal wires oriented perpendicular to the first horizontal wire and second horizontal wire. The storage label device includes: a label holder body having a smooth front face and an opposing back face, the holder body extending between a top edge, a bottom edge, a first side, and a second side; and a plurality of hooked clips formed along the upper edge of the label holder body, the plurality of clips including a pair of inner clips adjacent to one another and separated by a first distance, a pair of middle clips formed on opposing sides of the first inner pair of clips and separated from the pair of inner clips by a second distance that is greater than the first distance, and a pair of outer clips formed on opposing sides of the pair of middle clips and separated from the pair of middle clips by a third distance that is greater than the second distance. The plurality of longitudinal wires of the wire shelf are received between the pair of inner clips, the pair of middle clips, and the pair of outer clips of the storage label device, and wherein one of the first horizontal wire and second horizontal wire is received below the plurality of hooked clips formed along the upper edge of the label holder body to secure the storage label device to the wire shelf.

In one embodiment, the storage label device further includes a central gap formed between the pair of inner clips, a pair of middle gaps formed between the pair of inner clips and the pair of middle clips, and a pair of outer gaps formed between the pair of middle clips and the pair of outer clips.

In another embodiment, a width of the middle gaps is wider than a width of the center gap, and wherein a width of the outer gaps is wider than a width of the middle gaps. In yet another embodiment, a gap between the inner pair of clips has a width of from about 0.1" to about 0.2".

BRIEF DESCRIPTION OF THE DRAWINGS

Further features, aspects, and advantages of the present disclosure will become better understood by reference to the following detailed description, appended claims, and accompanying figures, wherein elements are not to scale so as to more clearly show the details, wherein like reference numbers indicate like elements throughout the several views, and wherein:

DETAILED DESCRIPTION

Various terms used herein are intended to have particular meanings. Some of these terms are defined below for the purpose of clarity. The definitions given below are meant to cover all forms of the words being defined (e.g., singular, plural, present tense, past tense). If the definition of any term below diverges from the commonly understood and/or dictionary definition of such term, the definitions below control.

Figure 1:
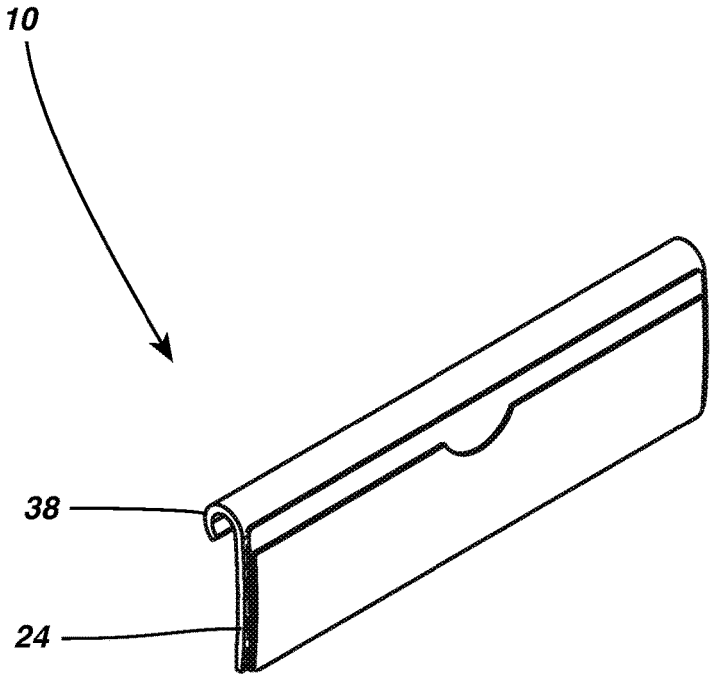
FIG. 1 shows a perspective side view of a storage label device according to one embodiment of the present disclosure.

FIG. 1 shows a basic embodiment of a storage label device 10 for mounting a label to a storage area, such as a wire shelf, container, or other storage mechanism. The storage label device 10 advantageously mounts to various storage areas to allow a user to label the storage areas according to items placed in or on the storage areas. The storage label device 10 is mountable on various storage areas having differing dimensions and configurations without requiring a user to purchase separate storage label devices.

Figure 2:
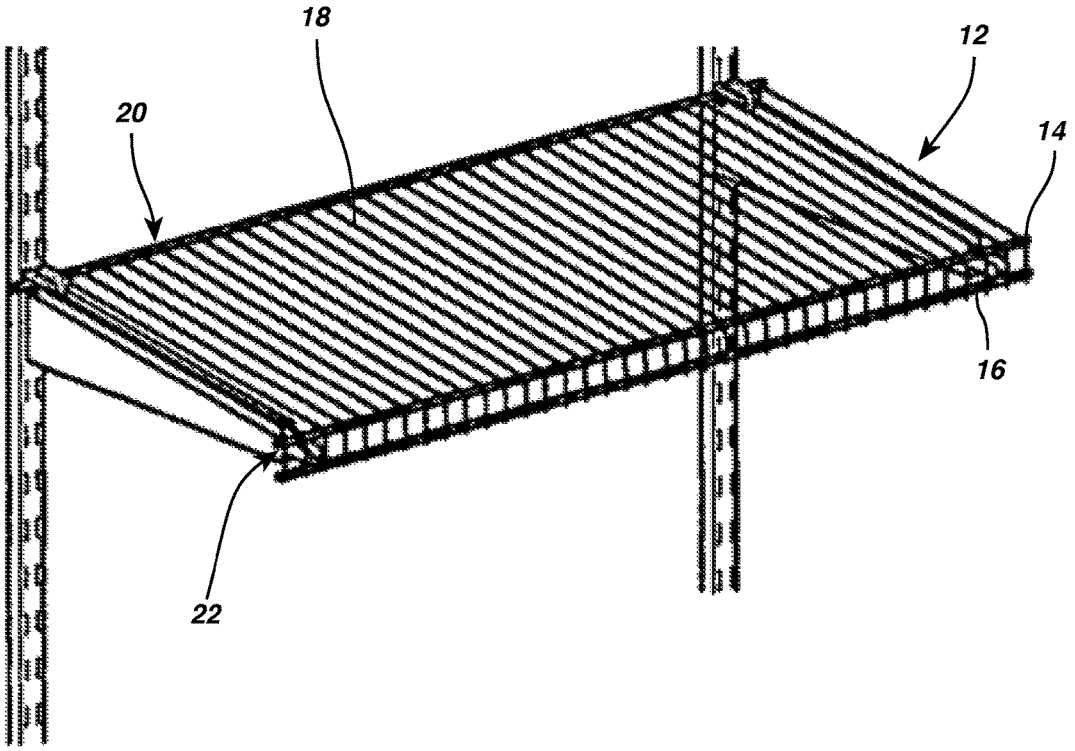
FIG. 2 shows a wire frame shelving storage area according to one embodiment of the present disclosure.

Referring to FIG. 2, the storage label device 10 is preferably configured to attach to an existing storage area, such as a wire shelf 12. The wire shelf 12 typically includes a first horizontal wire 14, a second horizontal wire 16 parallel to and below the first horizontal wire 14, and a plurality of longitudinal wires 18 oriented perpendicular to the first horizontal wire 12 and second horizontal wire 14. The plurality of longitudinal wires 18 preferably extend from a rear edge 20 of the wire shelf 12 to a front edge 22 and wrap over the first horizontal wire 14 before terminating at the second horizontal wire 16. Existing wire shelving products are available from various third parties, such as Closetmaid® and The Container Store®. While FIG. 2 illustrates one type of commonly available wire shelving, various other types of wire shelving are available, and the storage label device 10 of the present disclosure may be compatible with those wire shelving products. Further, while the storage area is described in one embodiment as a wire shelf 12, embodiments of the device of the present disclosure may also be mountable on other types of storage products such as on a cut-out for a handle for a storage bin or other similar product.

Figure 3:
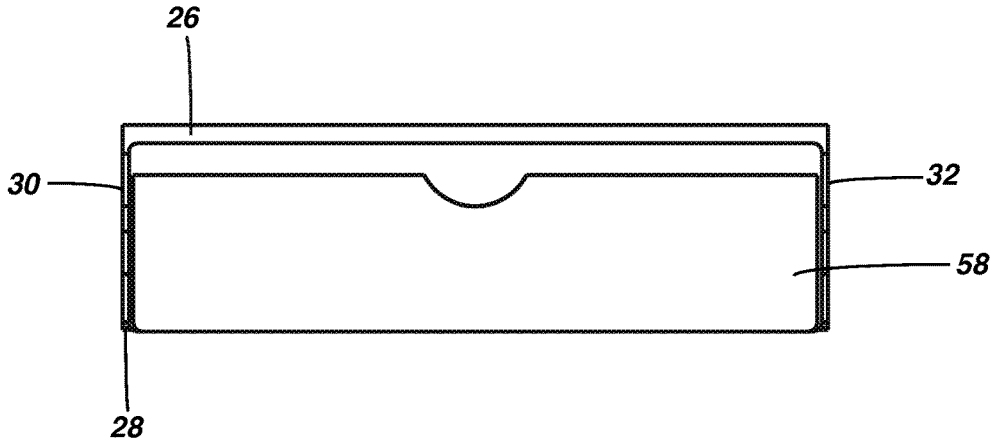
FIG. 3 shows a front view of a storage label device according to one embodiment of the present disclosure.
Figure 4:
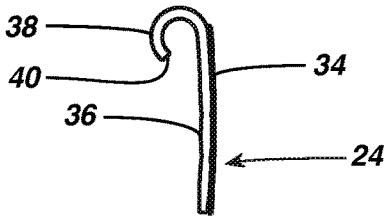
FIG. 4 shows a side view of a storage label device according to one embodiment of the present disclosure.

Referring again to FIG. 1, the storage label device 10 includes a label holder body 24 defined between a top edge 26, a bottom edge 28, a first side 30 and a second side 32 (FIG. 3). Referring to FIG. 4, the label holder body 24 includes a front surface 34 and an opposing rear surface 36. The front surface forms a substantially smooth surface area onto which a label pouch or other labeling device may be adhered or secured, as discussed in greater detail below. As shown in FIG. 4, the label holder body 24 is preferably curved between the top edge 26 and bottom edge 28 of the holder body 24. The label holder body 24 is curved such that the rear surface 36 of the label holder body 24 is concave and the front surface 34 is convex. The label holder body 24 may have varying dimensions such that labels or other visual indicia may be displayed on the front surface 34 of the label holder body.

A clip portion 38 is formed along the top edge 26 of the label holder body 24 and extends from the rear surface 36 of the label holder body 24. The clip portion 38 is shaped to conform around a portion of the storage area. For example, when the storage area comprises wire shelving as described above, the clip portion 38 is shaped to fit over one of the wires of the wire shelving storage area. In the embodiment of FIGS. 1 and 4, the clip portion 38 extends continuously along a length of the top edge 26 of the label holder body 24. The clip portion 38 curls downward along the rear surface 36 of the label holder body 24 and terminates at an end 40. The end 40 is curled towards the rear surface 36 of the label holder body 24 such that the clip portion 38 is shaped to receive and substantially entrap a cylindrical body within the clip portion 38.

Figure 5A:
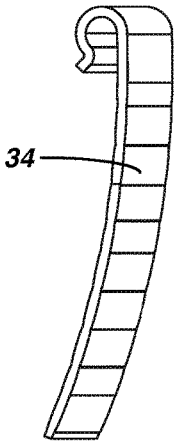
FIGS. 5A-5C show side views of a storage label device according to one embodiment of the present disclosure.
Figure 5B:
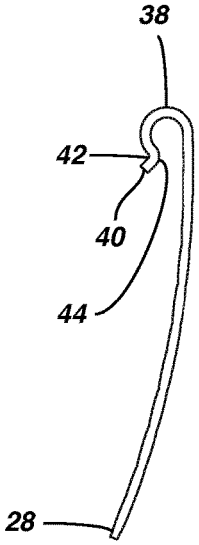
Figure 6A:
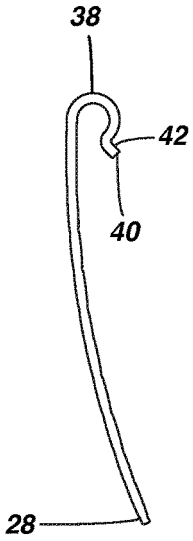
FIGS. 6A and 6B show a storage label device according to one embodiment of the present disclosure.

Referring to FIGS. 5B and 6A, in one embodiment the clip portion 38 features a lip 42 formed adjacent the end 40 of the clip portion 38. The end 40 of the clip portion 38 projects outwardly away from the rear surface 36 of the label holder body 24 after the lip 42. The lip 42 forms an inwardly projecting portion 44 that is shaped to contact a surface of a storage area, such as a surface of a container adjacent to a handle area or other surface of the storage area when the storage label device 10 is secured to the storage area.

In yet another embodiment, the clip portion 38 may be formed into a plurality of spaced apart clips 46 formed along the top edge 26 of the label holder body 24, as shown in FIGS. 7A-7D. Each of the plurality of spaced apart clips 46 includes a downward-facing hook 48 formed on the plurality of clips 46. The clips 46 are formed into a plurality of pairs that are spaced apart such that the storage label device 10 is capable of being mounted on wire shelving having various dimensions, such as varying spacing of longitudinal wires of the shelf. A pair of inner clips 50A and 50B are formed adjacent a central axis A of the with a center gap 51 defined between the pair of inner clips 50A and 50B. A pair of middle clips 52A and 52B are located on opposing sides of the pair of inner clips 50A and 50B and are separated from the inner clips 50A and 50B by middle gaps 53A and 53B. A width of the middle gaps 53A and 53B is preferably greater than a width of the center gap 51. Further, a width of the middle clips 52A and 52B is preferably narrower than a width of the pair of inner clips 50A and 50B. A pair of outer clips 54A and 54B are located on opposing sides of the pair of middle clips 52A and 52B and are separated from the middle clips 52A and 52B by outer gaps 55A and 55B. A width of the outer clips 54A and 54B is preferably narrower than a width of the middle clips 52A and 52B.

In one embodiment, a width of the center gap 51 is from about 0.1" to about 0.2", and preferably has a width of approximately 0.11" (2.9 mm). A width of the middle gaps 53A and 53B is preferably from about 0.2" to about 0.3", and preferably has a width of approximately 0.21" (5.3 mm). A width of the outer gaps 55A and 55B is preferably from about 0.3" to about 0.4", and preferably has a width of approximately 0.35" (8.9 mm). The pair of inner clips 50A and 50B preferably have a width of from about 0.3 to about 0.4", and preferably have a width of approximately 0.39" (9.8 mm). The pair of middle clips 52A and 52B preferably have a width of from about 0.2" to about 0.3", and preferably have a width of approximately 0.29" (7.4 mm). The pair of outer clips 54A and 54B preferably have a width of from about 0.2" to about 0.25", and preferably have a width of approximately 0.21" (5.3 mm).

Figure 8A:
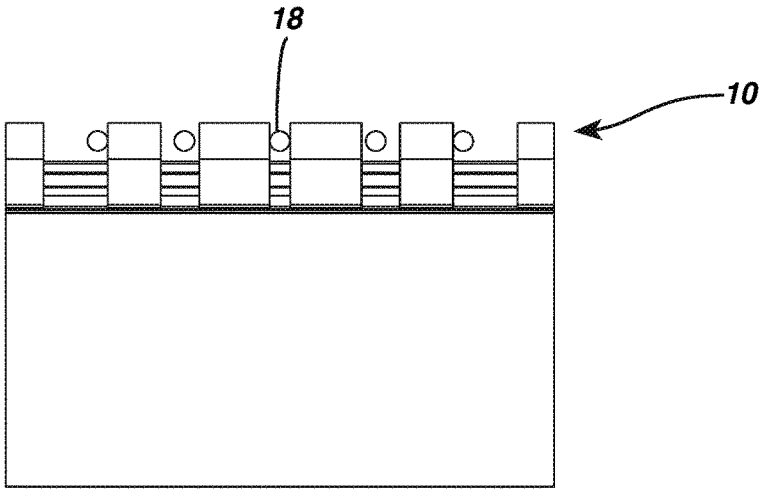
FIGS. 8A-8B show a storage label device engaged with components of a wire shelf according to one embodiment of the present disclosure.
Figure 8B:
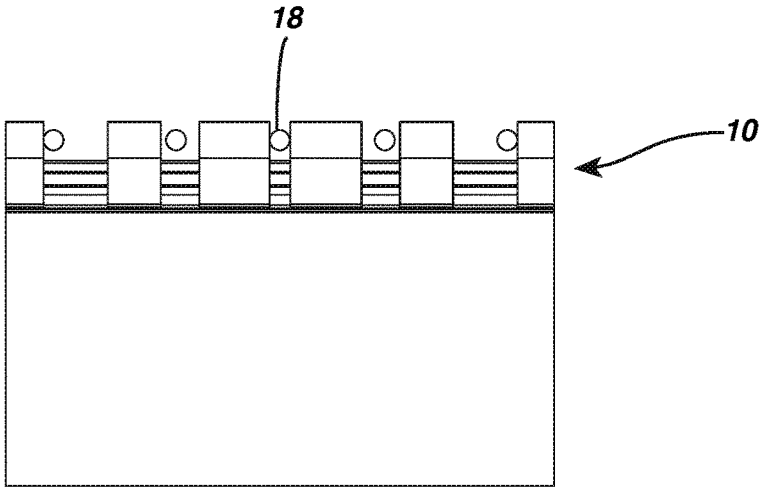
Figure 10:
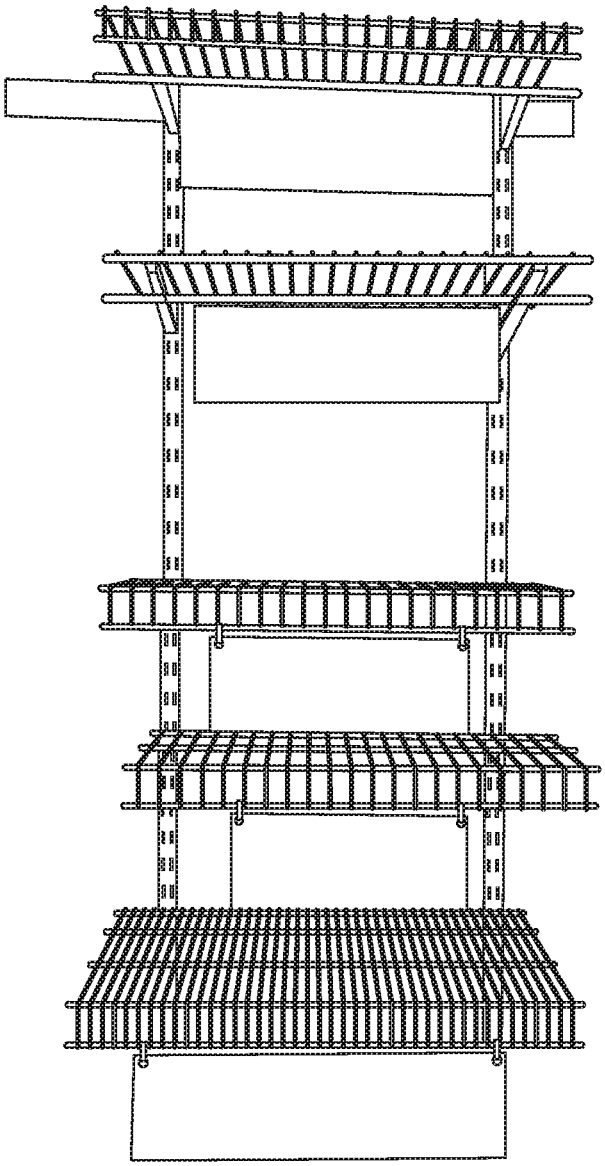
FIG. 10 shows various existing wire shelves with which embodiments of the storage label device of the present disclosure are compatible.

Widths and spacing between the inner clips 50A and 50B, middle clips 52A and 52B, and outer clips 54A and 54B allow the plurality of clips 46 to adapt to wire shelving having variable spacing and diameters, such as the shelves shown in FIG. 10. The storage label device 10 of the present disclosure has been found to be compatible with various wire shelves including those illustrated in FIG. 10. The clips 46 may be attached to longitudinal wires of wire shelving having a first spacing, and may also accommodate wire shelving having a second spacing between longitudinal wires. Referring to FIGS. 8A and 8B, one of the plurality of longitudinal wires 18 is first aligned with the center gap 51 of the storage label device 10. Depending on a spacing of the longitudinal wires 18 of the wire shelving, additional longitudinal wires 18 are located between the clips 46. FIG. 8A illustrates an exemplary wire shelf having longitudinal wires 18 with a narrower spacing, while FIG. 8B illustrates an exemplary wire shelf having longitudinal wires 18 with a wider spacing. The plurality of clips 46 secure the storage label device 10 to the wire shelving by securing longitudinal wires 18 within the gaps between the clips 46 and also by securing one of the horizontal wires within the hook-shaped clip portion 38.

The label holder body 24 and clip portion 38 are preferably formed of a resiliently flexible material, such as a resilient plastic or polymer. The label storage device 10 may be formed of various other suitable materials, such as wood, metal, and various suitable composite materials. The label holder body 24 and clip portion 38 may be integrally formed as a single piece.

Figure 5C:
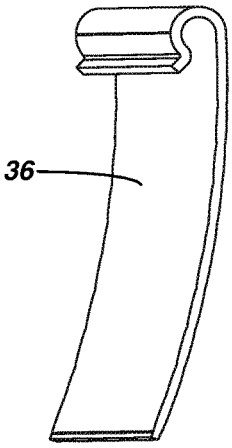
Figure 6B:
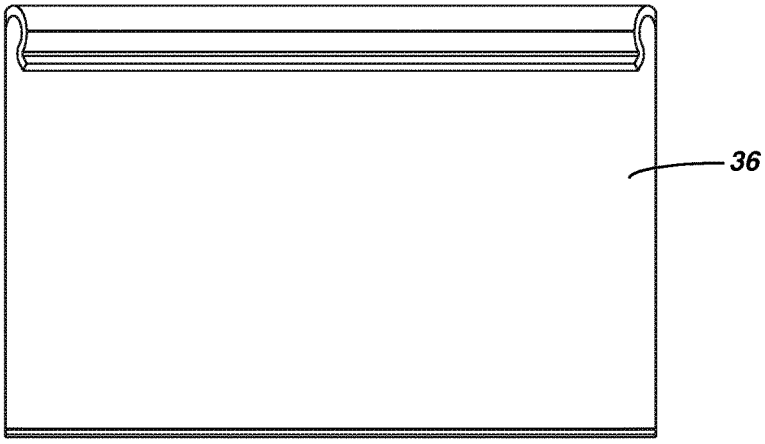
Figure 7A:
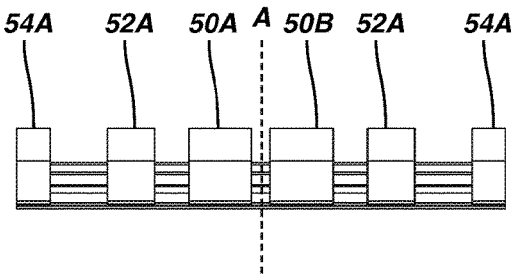
FIGS. 7A-7D show a storage label device having a plurality of clips according to one embodiment of the present disclosure.
Figure 7B:
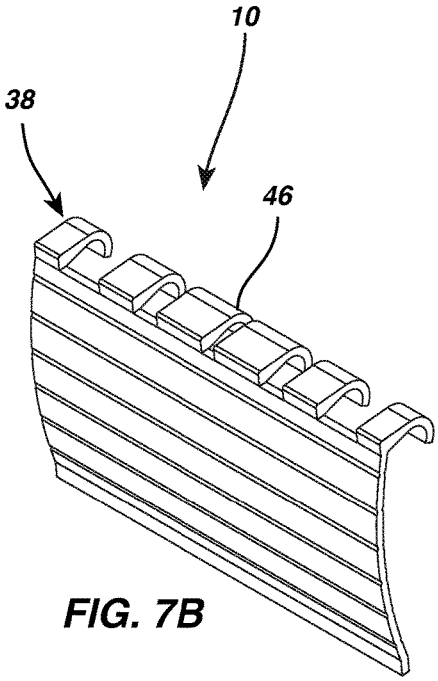
Figure 7C:
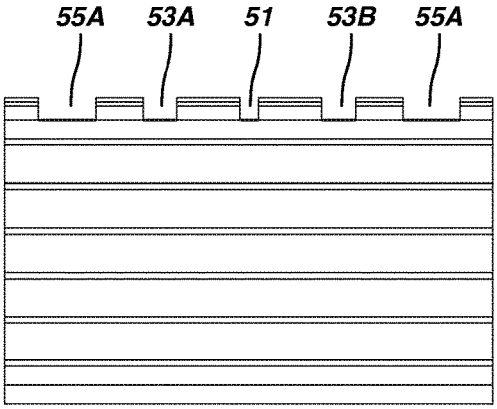
Figure 7D:
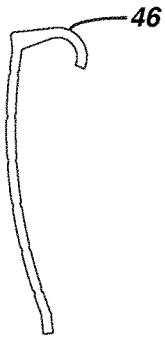
Figure 9:
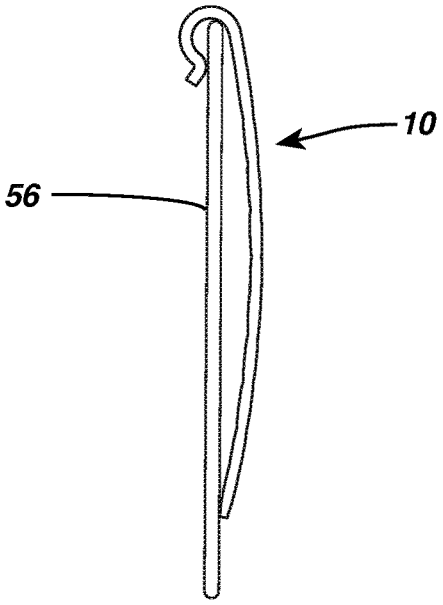
FIG. 9 shows a side view of a storage label device secured to a surface according to one embodiment of the present disclosure.

The clip portion 38 is preferably resiliently flexible such that the clip portion 38 may flex in relation to the label holder body 24 for attaching the storage label device 10 to a storage area. For example, as shown in FIG. 9, when the storage label device 10 of FIGS. 5 and 6 is attached to a surface 56, such as an outer surface of a fabric storage box, the label storage device 10 is maintained against the surface 56 at the clip portion 38 and towards the bottom edge 28 of the label holder body 24. In one embodiment, such as the embodiment shown in FIGS. 5 and 6, the label holder body 24 may curve such that the bottom edge 28 extends beyond a distal point of the clip portion 38. When the storage label device 10 is attached to a surface, as shown in FIG. 9, the label holder body 24 and clip portion 38 may be flexed such that when the storage label device 10 is secured to the surface the storage label device 10 is in tension to prevent the storage label device 10 from inadvertently detaching from the surface.

Referring again to FIGS. 1 and 3, a label pouch 58 is preferably adhered or otherwise attached to the label holder body 24, such as on the front surface 34 of the label holder body 24. The label pouch 58 is shaped to receive a label or other visual device within the label pouch 58 such that when the storage label device 10 is attached to a storage area, the label or other visual device is visible through the label pouch 58 towards a user attempting to locate items at the storage area.

The storage label device 10 of the present disclosure advantageously allows a user to place a label or other visual device onto a storage area and securely maintains the label to the storage area while allowing the user to move the label as desired. The storage label device 10 is readily attached to various storage areas. In one preferable embodiment, the storage label device 10 is attached to a wire shelf to allow a user to mark a location of items stored on the wire shelf. In other embodiments describe herein, the storage label device 10 is readily attached to other storage areas to allow a user to label items placed within those storage areas while also allowing the user to change labels or relocate the storage label device 10.

The foregoing description of preferred embodiments of the present disclosure has been presented for purposes of illustration and description. The described preferred embodiments are not intended to be exhaustive or to limit the scope of the disclosure to the precise form(s) disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the concepts revealed in the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. A storage label device for mounting a label on a wire shelf, the wire shelf having a first horizontal wire, a second horizontal wire parallel to and below the first horizontal wire, and a plurality of longitudinal wires oriented perpendicular to the first horizontal wire and second horizontal wire, the storage label device comprising:

a label holder body having a smooth front face and an opposing back face, the holder body extending between a top edge, a bottom edge, a first side, and a second side; and a plurality of hooked clips formed along the upper edge of the label holder body, the plurality of clips including a pair of inner clips adjacent to one another and separated by a first distance, a pair of middle clips formed on opposing sides of the first inner pair of clips and separated from the pair of inner clips by a second distance that is greater than the first distance, and a pair of outer clips formed on opposing sides of the pair of middle clips and separated from the pair of middle clips by a third distance that is greater than the second distance;

wherein the plurality of longitudinal wires of the wire shelf are received between the pair of inner clips, the pair of middle clips, and the pair of outer clips of the storage label device, and wherein one of the first horizontal wire and second horizontal wire is received below the plurality of hooked clips formed along the upper edge of the label holder body to secure the storage label device to the wire shelf.

2. The storage label device of claim 1, wherein the label holder body is resiliently flexible relative to the plurality of hooked clips.

3. The storage label device of claim 1, further comprising a lip formed in the plurality of hooked clips.

4. The storage label device of claim 1, wherein the label holder body and clip portion are integrally formed as a single piece.

5. The storage label device of claim 4, wherein the label holder body and plurality of hooked clips are molded from a resilient plastic.

6. The storage label device of claim 1, further comprising a central gap formed between the pair of inner clips, a pair of middle gaps formed between the pair of inner clips and the pair of middle clips, and a pair of outer gaps formed between the pair of middle clips and the pair of outer clips.

7. The storage label device of claim 6, wherein a width of the middle gaps is wider than a width of the center gap, and wherein a width of the outer gaps is wider than a width of the middle gaps.

8. The storage label device of claim 1, wherein a gap between the inner pair of clips has a width of from about 0.1" to about 0.2".

* * * * *